US008907857B2

(12) United States Patent
Nysen

(10) Patent No.: US 8,907,857 B2
(45) Date of Patent: Dec. 9, 2014

(54) COMPACT MULTI-ANTENNA AND MULTI-ANTENNA SYSTEM

(75) Inventor: Paul A. Nysen, Carlsbad, CA (US)

(73) Assignee: NETGEAR Inc., San Jose, CA (US)

( * ) Notice: Subject to any disclaimer, the term of this patent is extended or adjusted under 35 U.S.C. 154(b) by 167 days.

(21) Appl. No.: 13/247,443

(22) Filed: Sep. 28, 2011

(65) Prior Publication Data

US 2013/0078935 A1 Mar. 28, 2013

(51) Int. Cl.
*H01Q 1/00* (2006.01)
*H01Q 5/00* (2006.01)
*H01Q 21/28* (2006.01)

(52) U.S. Cl.
CPC ..... *H01Q 5/0072* (2013.01); *H01Q 21/28* (2013.01)
USPC ..... 343/730; 343/729

(58) Field of Classification Search
CPC ..... H01Q 3/01; H01Q 3/24; H01Q 3/247; H01Q 3/26; H01Q 3/2629; H01Q 5/0006; H01Q 5/0024; H01Q 5/0027; H01Q 5/0048; H01Q 5/0068; H01Q 5/0072; H01Q 9/285; H01Q 9/0414; H01Q 9/26
USPC ..... 343/729, 730, 797, 867, 893
See application file for complete search history.

(56) References Cited

U.S. PATENT DOCUMENTS

| | | | | |
|---|---|---|---|---|
| 6,567,053 | B1 * | 5/2003 | Yablonovitch et al. | 343/767 |
| 2008/0136734 | A1 * | 6/2008 | Manholm et al. | 343/893 |
| 2010/0127944 | A1 * | 5/2010 | Breiter | 343/729 |
| 2010/0220022 | A1 * | 9/2010 | Yoon et al. | 343/727 |

OTHER PUBLICATIONS

The ARRL Antenna Book, 1988, The American Radio Relay League, 15th edition, 2-24 and 2-25.*
Carr, Antenna Toolkit, 2001, Newnes, 2nd, p. 95.*
Niekerk et al, Loop Antenna Basics and Regulatory Compliance for Short-Range Radio, Aug. 2002, Microchip, vol. 6, 1-15.*
Underhill, Magnetic Loop or Small Folded Dipole, Jul. 1997, IEEE, vol. 411, pp. 216-222.*

* cited by examiner

*Primary Examiner* — Hoang V Nguyen
*Assistant Examiner* — Patrick Holecek
(74) *Attorney, Agent, or Firm* — Boyle Fredrickson, S.C.

(57) ABSTRACT

A compact multi-antenna, multi-antenna system, and wireless device comprising same are provided. The multi-antenna comprises first, second and third antennas. The second antenna contains the first antenna, and the third antenna contains at least part of the second antenna. The first antenna may be a slot-in-slot or other antenna, the second antenna may be a dipole, and the third antenna may be a dipole or monopole. The multi-antenna system comprises the multi-antenna plus first, second and third transmission systems operatively coupled thereto. The antennas of the multi-antenna and system may be concurrently operated, substantially independently, and may have mutually orthogonal polarizations. Particular antenna and system configurations are also disclosed.

16 Claims, 6 Drawing Sheets

COMPACT MULTI-ANTENNA AND MULTI-ANTENNA SYSTEM

TECHNICAL FIELD

The present technology pertains in general to radio antennas and in particular to a compact multi-antenna, compact multi-antenna system, and wireless device comprising same.

BACKGROUND

A recent trend in wireless communications has been to utilize multiple transmit and/or receive antennas, for example to provide for antenna diversity to improve communication quality. For example, in Multiple-input and multiple-output (MIMO) systems, both transmitter and receiver in a wireless communication system use multiple antennas for communication. Other related topics include antenna polarization diversity, pattern diversity, spatial diversity, smart antennas, adaptive antenna arrays, and adaptive beam forming, for example.

Often, it is desirable to provide adequate radio antenna components within a small package. For example, for portable wireless devices such as handheld cell phones, smart phones, PDAs, embedded wireless devices, peripheral devices such as wireless USB™ adapters, and the like, small size is desirable for reasons such as portability and cost. However, the drive toward smaller size may conflict with the drive toward multiple antennas, since more antennas typically require more space.

U.S. Pat. No. 5,532,708 discloses a compact dual mode antenna which includes a single compact radiating structure and an electronic switch for driving the radiating structure either as a split dipole antenna or as a top-loaded monopole antenna, thereby facilitating polarization and pattern diversity. However, a drawback of this design is that only one excitation mode may be used at a time.

U.S. Pat. No. 6,529,749 discloses a compact multi-band antenna which can be selectively driven in different configurations. In a first configuration, first and second conductive branches can jointly radiate as a dipole antenna, while in a second configuration the first and second conductive branches can be operated separately as inverted-F antennas, or they may radiate independently as monopole antennas. Again however, a drawback of this design is that only one excitation mode may be used at a time.

U.S. Pat. No. 7,012,568 discloses a multiresonant antenna structure having various resonant modes which share at least portions of the structure volume. The basic antenna element has a ground plane and a pair of spaced-apart conductors electrically connected thereto, with additional elements coupled thereto by stacking, nesting, or juxtaposition in an array. However, the multiresonant antenna structure is designed to increase overall bandwidth, with different configurations used at different times.

In addition, the above approaches are limited to specific configurations and arrangements of antenna elements, which may not be suitable for some applications, for example due to their physical, electrical and/or electromagnetic characteristics. For example, the above approaches may not be suitable for supporting one or more of: desired polarization diversity, a desired radiation pattern, and a desired physical form factor.

Therefore there is a need for a compact multi-antenna, compact multi-antenna system and wireless device comprising same that is not subject to one or more limitations of the prior art.

This background information is provided for the purpose of making known information believed by the applicant to be of possible relevance to the present technology. No admission is necessarily intended, nor should be construed, that any of the preceding information constitutes prior art against the present technology.

SUMMARY

An object of the present technology is to provide a compact multi-antenna. In accordance with an aspect of the present technology, there is provided a multi-antenna comprising: a first system of one or more radiating bodies configured as a first antenna; a second antenna comprising the first system and a second system of one or more radiating bodies, the first system and the second system configured to be driven differentially with respect to each other as a dipole antenna; and a third antenna comprising a conductive body and a third system, the third system including the first system or the second system or both, wherein the third system is configured to be driven differentially with respect to the conductive body.

In accordance with another aspect of the present technology, there is provided a multi-antenna system comprising: a first system of one or more radiating bodies configured as a first antenna; a first transmission system operatively coupled to the system of one or more radiating bodies; a second antenna comprising the first system and a second system of one or more radiating bodies, the first system and the second system arranged in a spaced-apart configuration; a second transmission system operatively coupled to the first system and the second system and configured for differential operation of first system and the second system as a dipole antenna; a third antenna comprising a conductive body and a third system, the third system including the first system or the second system or both; and a third transmission system operatively coupled to conductive body and the third system, the third transmission system for operation of said third system differentially with respect to the conductive body.

In accordance with another aspect of the present technology, there is provided a wireless device comprising the above-described multi-antenna.

In accordance with another aspect of the present technology, there is provided a wireless device comprising the above-described multi-antenna system.

BRIEF DESCRIPTION OF THE FIGURES

These and other features of the technology will become more apparent in the following detailed description in which reference is made to the appended drawings.

DETAILED DESCRIPTION OF THE TECHNOLOGY

Definitions

Figure 1:
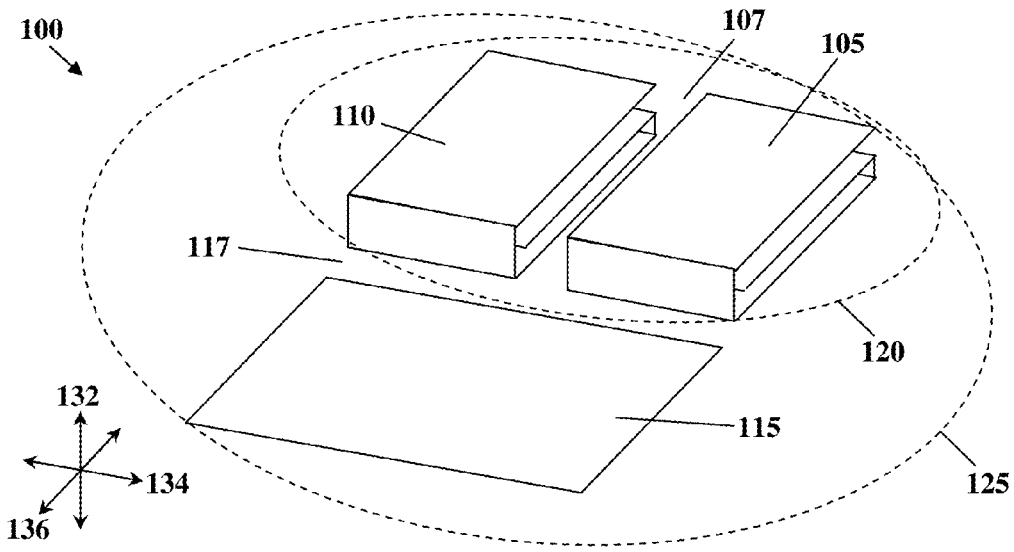
FIG. 1 illustrates a compact multi-antenna, in accordance with embodiments of the technology.

The term "antenna" is used to define a structure which comprises one or more electrical conductors which operate or co-operate to convert between electrical current and electromagnetic radiation.

The term "multi-antenna" is used to define a structure which comprises a plurality of antennas, for example for operation at one or more predetermined radio frequencies. As described herein, two or more antennas of a multi-antenna may share common structural components, such as electrical conductors or portions thereof.

As used herein, electrical conductors of an antenna or multi-antenna may also be referred to, where appropriate, as conductive elements, conductive bodies, and/or radiating bodies.

As used herein, the term "radiating body" refers to an electrical conductor of an antenna or multi-antenna. A radiating body radiates electromagnetic energy in a transmitting antenna, and, in a receiving antenna, resonates when subjected to an appropriate electromagnetic field.

The terms "antenna system" and "multi-antenna system" are used to define one or more antennas or multi-antennas, respectively, along with appropriate electronic components and/or transmission lines, and/or transmission systems comprising transmission lines, operatively coupled thereto, and configured for radio transmission, radio reception, or both. The term "system" may also be used herein in other respects to describe sets of one or more interacting or related components.

The term "driven," when applied to antennas or antenna systems, is used herein to refer to the process of inducing electrical current in one or more conductors of the antennas or antenna systems, either via immersion in an appropriate electromagnetic field or via application of appropriate current or voltage at one or more antenna feedpoints. An antenna or antenna system may thus be operated for radio reception and/or radio transmission.

As used herein, the term "about" refers to a +/−10% variation from the nominal value. It is to be understood that such a variation is always included in a given value provided herein, whether or not it is specifically referred to.

Unless defined otherwise, all technical and scientific terms used herein have the same meaning as commonly understood by one of ordinary skill in the art to which this technology belongs.

An aspect of the present technology provides for a multi-antenna comprising at least a first antenna and a second antenna. A first system of one or more radiating bodies is configured as the first antenna. The first antenna may be, for example, a slot antenna, notch-in-notch antenna, or other antenna as described herein, and may be formed substantially from a single radiating body or a system of electrically connected radiating bodies. The second antenna comprises the first system of one or more radiating bodies as well as a second system of one or more radiating bodies. In some embodiments, the second system may be physically and/or electrically similar to the first system. The first system and the second system may be arranged in a spaced-apart configuration and are configured for being driven differentially with respect to each other, for example as two complementary halves of a dipole antenna, which may be substantially center-fed.

An aspect of the present technology also provides for a third antenna. The third antenna comprises a conductive body and a third system. The third system comprises one or both of the aforementioned first system of one or more radiating bodies and the second system of one or more radiating bodies. The conductive body may be a ground plane, counterpoise, radiating body, or the like. The conductive body may be placed in a spaced-apart configuration with the third system, thereby providing a gap at which a feedpoint of the third antenna may be defined. The third system is configured for being driven differentially of the conductive body. For example, the first system and the second system may be driven in phase, that is, in common-mode, as a combined third system of radiating bodies, the combined third system of radiating bodies thus being driven differentially of the conductive body to operate the third antenna as a monopole or dipole antenna, depending on the nature of the conductive body.

An aspect of the present technology provides for a multi-antenna system comprising the first antenna, the second antenna and the third antenna, as described above, along with first, second and third transmission systems operatively coupled to the first, second and third antennas, respectively, at appropriate antenna feedpoints. The transmission systems may comprise microstrip, stripline or coaxial transmission lines, coupled at one end to the appropriate antennas at predetermined feedpoints, and coupled at another end to radio-frequency (RF) electronics such as amplifiers. The transmission systems may further comprise other elements, such as Baluns, wave traps, transformers, impedance changing or matching structures, or the like. The first transmission system is operatively coupled to the system of one or more radiating bodies. The second transmission system is operatively coupled to the first system and the second system and configured for differential operation of the second antenna as a dipole antenna. The third transmission system is operatively coupled to the conductive body and to the third system, that is, the one or both of the first system and the second system. The third transmission system is configured for operation of the third system differentially of the conductive body. In the case that the third antenna comprises both of the first system and the second system, the third transmission system may be configured to convey a common-mode or in-phase signal to both the first system and the second system.

Embodiments of the present technology provide for a physical structure of the multi-antenna system which facilitates substantially independent operation of the different antennas thereof. For example, the transmission systems, radiating bodies, and conductive body may be configured, for example by shape, provision of wave traps, or the like, such that electrical and/or electromagnetic signals conveyed by the first antenna and the first transmission system are substantially independent and/or do not substantially interfere, or at least interfere at a level below a predetermined threshold, with electrical and/or electromagnetic signals conveyed by the second and third antennas and the second and third transmission systems. The second and third antennas and transmission systems may similarly be configured for operation independent of the other two antennas. In some embodiments, such independent operation may facilitate substantially concurrent operation of plural antennas of the multi-antenna system. Independence of antenna systems may also provide benefits such as simplification of antenna system design and/or operation.

Other aspects of the present technology, as described herein, may provide for a method for providing a multi-antenna or multi-antenna system as described above, for example according to manufacturing and/or assembly operations, and for a wireless device, such as a computer, mobile phone, smart phone, wireless camera, wireless router, USB™ wireless modem or wireless adapter, other radio-enabled device, or the like, comprising a multi-antenna or multi-antenna system as described above.

FIG. 1 illustrates a multi-antenna 100 in accordance with an embodiment of the present technology. The multi-antenna generally comprises a first radiating body 105, a second radiating body 110, and a conductive body 115, such as a radiating body, counterpoise, ground plane portion, or the like. The first radiating body 105 may be configured as a first antenna, being a notch-in-notch antenna, as illustrated. Alternatively, a first system of radiating bodies may be used in place of the first radiating body, for example configured as an aperture antenna, a slot antenna, a notch antenna, a patch antenna, planar inverter F antenna (PIFA), or the like.

The second radiating body 110 is provided adjacent to and spaced apart from the first radiating body 105. A gap 107 is thereby formed between the first radiating body 105 and the second radiating body 110. As illustrated, the second radiating body 110 may be physically and electrically similar to the first radiating body 105. By virtue of their spatial separation this may also provide for co-polarized MIMO or diversity. The first radiating body 105 and the second radiating body 110 form two halves of a dipole antenna 120. In some embodiments, the second radiating body 110 may also form an additional antenna, for example an aperture antenna, slot antenna, notch antenna, notch-in-notch antenna, or the like. A second antenna, being the dipole antenna 120, is thus provided, the second antenna fed at a feedpoint across the gap 107.

The conductive body 115, which may be a grounded conductive body or ungrounded radiating body, is provided adjacent to and spaced apart from the first radiating body 105 and the second radiating body 110. A gap 117 is thereby formed between the conductive body 115 and both the first radiating body 105 and the second radiating body 110. The gaps 107 and 117 together form a "T"-shaped system of gaps.

According to some embodiments, the conductive body 115 may be replaced with a system similar to dipole antenna 120, wherein the spatially located antennas could provide for a four element coplanar array thus enabling a four by four MIMO system, for example.

In some embodiments, the conductive body 115, the first radiating body 105 and the second radiating body 110 form a third antenna 125, such as a dipole antenna, wherein the conductive body 115 forms a first half of the dipole antenna, and the first radiating body 105 and the second radiating body 110 together form a second half of the dipole antenna. If the conductive body 115 is grounded or forms part of a ground plane, the third antenna may be considered to be a monopole antenna. The third antenna may be fed at one or more feed points across the gap 117.

In some embodiments, the third antenna is formed of the conductive body 115 and one of the first radiating body 105 and the second radiating body 110. Thus, the other of the first radiating body 105 and the second radiating body 110 is excluded from the third antenna although still physically present and operating as part of the first and/or second antennas.

In some embodiments, the first antenna has a polarization in a first direction 132, the second antenna has a polarization in the direction 134, and the third antenna has a polarization in the direction 136, the three directions 132, 134, 136 being substantially orthogonal to each other. Other polarizations, for example being substantially linear, circular, or elliptical, may also be provided by appropriate configuration of the multi-antenna, as would be readily understood by a worker skilled in the art.

Figure 2:
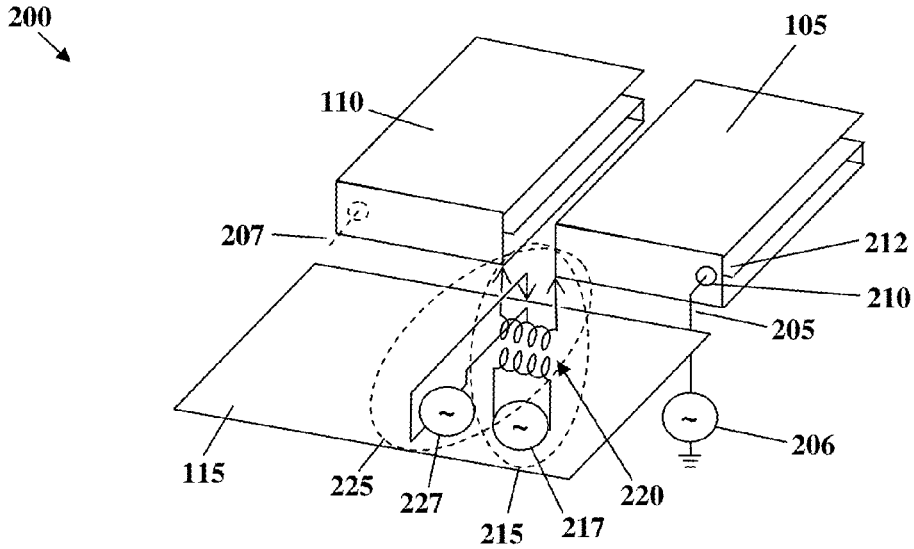
FIG. 2 illustrates a compact multi-antenna system, in accordance with embodiments of the technology.

FIG. 2 illustrates a multi-antenna system 200 in accordance with an embodiment of the present technology. As illustrated, the multi-antenna system 200 comprises the radiating bodies 105, 110 and conductive body 115 of the multi-antenna 100, these bodies configured and arranged as described above with respect to FIG. 1. A first transmission system 205 is operatively coupled to the first radiating body 105 forming the first antenna. The first transmission system comprises a transmission line 205, such as a stripline. In the illustrated embodiment, a central conductor of the transmission line may pass through an aperture 210 of an outer plate to connect with an inner plate 212 of the radiating body 105. Ground or shield portions of the transmission line 205 may be coupled to the radiating body 105, for example at the aperture 210 and outer plate. If an additional antenna is formed of the second radiating body 110, a transmission system 207 may be operatively coupled to the second radiating body 110 in a manner similar to the transmission system 205 and the first radiating body 105. A signal source and/or sink 206 may be operatively coupled to the first transmission system 205, for conveying a signal to and/or from the first antenna. A signal source may comprise radiofrequency (RF) electronics such as a power amplifier. A signal sink may comprise RF electronics such as a low noise amplifier. A signal source and/or sink may comprise an RF front end, for example comprising matching circuitry, filtering circuitry, amplification circuitry, switching circuitry, and the like, as would be readily understood to a worker skilled in the art.

As further illustrated in FIG. 2, a second transmission system 215 is operatively coupled to the first radiating body 105 and the second radiating body 110 for operation of the second antenna as a dipole antenna. The second transmission system 215 comprises a pair of conductors, each connected to a corresponding one of the first and second radiating bodies on either side of an appropriately sized gap, as would be readily understood to a worker skilled in the art for connecting a dipole antenna to a transmission line, such as a balanced line. In the present embodiment, the second transmission system 215 comprises a transformer 220, configured to pass a signal between, on one side, the first and second radiating bodies 105, 110 and, on another side, a signal source and/or sink 217. The transformer 220 comprises a first winding and a second winding, the first winding and the second winding inductively coupled to each other. The first winding comprises a pair of terminals which are operatively coupled to the first and second radiating bodies. The second winding comprises a pair of terminals which are operatively coupled to a signal source and/or sink 217. Thus, a differential signal applied to terminals of one of the first winding or the second winding results in a corresponding differential signal applied at the terminals of the other of the first winding or the second winding. The number of windings in the first and second windings of the transformer 220 may, for example, be substantially in a one-to-one ratio, however this ratio is to be considered non-limiting. According to some embodiments, the ratio can be greater than one-to-one and in some embodiments the ratio can be less than one-to-one. A differential signal may be conveyed between the signal source and/or sink 217 and the first radiating body 105 and the second radiating body 110, by the second transmission system 215, the differential signal passing through the transformer 220.

As further illustrated in FIG. 2, a third transmission system 225 is operatively coupled to the first radiating body 105, the second radiating body 110 and the conductive body 115 for operation of the third antenna. The third transmission system 225 is further operatively coupled to a signal source and/or sink 227. The third transmission system 225 comprises a conductor operatively coupled at one end to the signal source and/or sink 227 and at another end to the conductive body 115. The third transmission system 225 further comprises a conductor operatively coupled at one end to the signal source and/or sink 227 and at another end to a center tap of the first winding of the transformer 220. The third transmission system thus comprises the first winding of the transformer 220 and the conductors operatively coupled between the end terminals of the first winding and the first and second radiating bodies. The first and second radiating bodies are operated in common mode via the transformer center tap and differentially of the conductive body 115, for example via a balanced line of the third transmission system 225.

The transformer 220 may be a coil wound transformer or other suitable transformer, including distributed, coupled transmission lines or equivalent discrete component circuits, configured to pass signals within a frequency range corresponding to operation of the second and third antennas. In some embodiments, care must be taken to ensure that the provide transformer 220 is capable of adequately passing signals in the high frequency ranges often used for radio communication, for example from 700 MHz to 2500 MHz. Eddy current losses and other losses may thus play an important role in the choice to use or not use a coil wound transformer, and/or the design and configuration of such a transformer.

Figure 3:
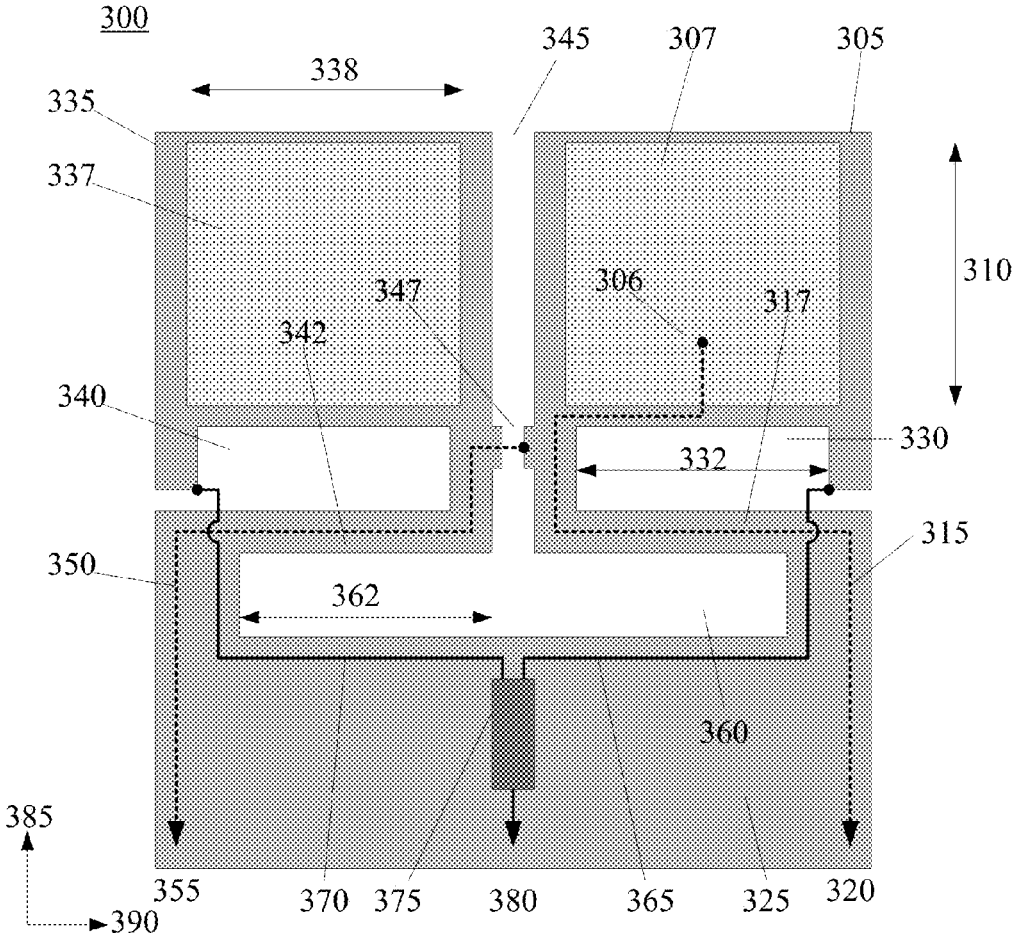
FIG. 3 illustrates a compact multi-antenna system, in accordance with embodiments of the technology.

FIG. 3 illustrates a multi-antenna system 300 in accordance with an embodiment of the present technology. The multi-antenna system comprises a first radiating body 305 configured as a first antenna. For example, the first radiating body may comprise a conductive plate defining an aperture 307 therein, the first antenna thus being a slot or patch or top loaded monopole antenna. In some embodiments, the first antenna is a substantially square slot antenna, having length 310 of substantially a quarter of an operating wavelength, the operating wavelength corresponding to a center operating radio frequency. The first radiating body 305 may alternatively be a notch antenna, notch-in-notch antenna, loop antenna, aperture antenna, patch antenna, PIFA, or the like.

The first radiating body 305 is further operatively coupled to a first transmission system 315 for example comprising a microstrip or stripline transmission line. The first transmission system 315 is operatively coupled at a feed point 306 of the first radiating body 305, the feed point 306 being, for example, a slot antenna feed as would be readily understood to a worker skilled in the art. The first transmission system 315 may further be operatively coupled to a signal source and/or sink 320. As illustrated, the first transmission system 315 is routed over a substantially "L"-shaped conductive portion 317 connected between the first radiating body 305 and the conductive body and/or ground plane 325. Although the conductive portion 317 electrically connects the first radiating body 305 and conductive body 325 at low frequencies, the antenna system 300 may be configured such that the first radiating body 305 is substantially electrically separate from the conductive body 325 at the antenna system's operating frequencies. For example, the transmission system 315 and conductive portion 317 may be routed around a notch or gap 330 having a length 332 of substantially a quarter wavelength of an antenna operating frequency, and the conductive portion may have a limited predetermined width. According to some embodiments, the notch length 332 can be substantially reduced or shortened by the use of shunt capacitive loading at the open end. The conductive portion 317 may be sized in terms of wavelengths and other features to impede undesired interference between portions of the antenna system. Such structure may facilitate isolation of portions of the antenna system, as would be readily understood by a worker skilled in the art.

The antenna system 300 further comprises a second radiating body 335, which may be substantially physically and/or electrically similar to the first radiating body 305. The first and second radiating bodies may have lengths 310 and 338 of substantially a quarter of an operating wavelength. In some embodiments, the second radiating body 335 may be configured as an additional antenna, similarly to the first antenna, and operatively coupled to an additional transmission system (not shown), similarly to the first transmission system 315. The second radiating body may define an aperture 337 therein, or be configured having at least the shape of a notch antenna, notch-in-notch antenna, loop antenna, aperture antenna, patch antenna, PIFA, or the like. The second radiating body 335 may be separated from the conductive body 325 at least by a notch or gap 340, for example having a length substantially of a quarter wavelength of an antenna operating frequency, similarly to length 332 of the gap 330. According to some embodiments, the notch length can be substantially reduced or shortened by the use of shunt capacitive loading at the open end. The second radiating body may further be separated from the first radiating body 305 by a gap 345.

Continuing with respect to FIG. 3, a second, dipole antenna is formed of the first radiating body 305 and the second radiating body 335. A second transmission system 350, for example comprising a microstrip or stripline transmission line, is operatively coupled to the second antenna at a feed point 347 located at the gap 345. The second transmission system 350 is further operatively coupled to a signal source and/or sink 355. As with the first transmission system, the second transmission system is routed around the gap 340 over a conductive portion 342. The second antenna may be substantially isolated from the conductive body 325, at least at antenna operating frequencies, for example by the placement and dimensioning of the gaps 330, 340, and the conductive portions 317, 342, and the gap 360.

Continuing with respect to FIG. 3, a third antenna is formed of the first radiating body 305, the second radiating body 335, and the conductive body 325. The first and second radiating bodies 305, 335 may be isolated from the conductive body 325, at least for operating frequencies of the antenna system, at least in part by the system of gaps 330, 340, 360.

The third antenna system is operatively coupled to a third transmission system. The third transmission system comprises a transmission line 365 operatively coupled to the first radiating body 305 and a signal splitter/combiner 375, and a transmission line 370 operatively coupled to the second radiating body 335 and the signal splitter/combiner 375. The transmission lines 365, 370 may be stripline coaxial cable, or microstrip transmission lines. The transmission line 365 is operatively coupled to the first radiating body 305 across a narrowed portion of the gap 330, and the transmission line 370 is operatively coupled to the second radiating body 335 across a narrowed portion of the gap 340. The transmission lines 365, 370 of the third transmission system are routed around the gap 360. The signal splitter/combiner 375 is operatively coupled to a signal source and/or sink 380, the signal splitter/combiner 375 configured for splitting a signal from the signal source and/or sink 380 into two, optionally balanced signals, and/or for combining signals from the transmission lines 365, 370 into a single signal for transmission to the signal source and/or sink 380.

The gap/notch 360 may be configured having a center region substantially in line with the gap 345, the gap 360 extending from the center region to undercut both the first radiating body 305 and the second radiating body 335, thereby at least partially defining the shapes of conductive portions 317 and 342. The gap/notch 360 may extend underneath the second radiating body 335 to a length 362 substantially of a quarter wavelength of an antenna operating frequency, and may similarly extend underneath the first radiating body 305. According to some embodiments, the gap/notch length can be reduced by using shunt capacitive loading across the gap 345 at or near the feed point 347. The gap/notch 360 may thereby facilitate isolation of portions of the antenna system, as would be readily understood by a worker skilled in the art.

In some embodiments, the third antenna may comprise only one of the first radiating body 305 and the second radiating body 335, in which case the combiner 375 and a corresponding one of the transmission lines 365 and 370 may be omitted. This embodiment may reduce symmetry and isolation of the third antenna, but may simplify design and/or operation. In some embodiments, the third antenna may comprise the first radiating body 305 and the conductive body 325, and an additional antenna may comprise the second radiating body 335 and the conductive body 325.

FIG. 3 further illustrates a polarization axis 390 of the second antenna and a polarization axis 385 of the third antenna, in accordance with embodiments of the present technology. A polarization direction of the first antenna may be substantially perpendicular to the two directions 385 and 390, that is, perpendicular to the page. According to embodiments, the two antenna systems 305 and 335 can be spatially separated and may operate concurrently and independently so as to provide for a co-planar MIMO capacity.

Embodiments, features and alternatives of the present technology, having generally been described above, will be discussed in further detail below.

First Antenna

In accordance with the present technology, there is provided a first system of one or more radiating bodies configured as a first antenna.

In embodiments of the present technology, the first system of one or more radiating bodies may be arranged as, or out of, a single conductive body, or as plural conductive bodies which are electrically coupled to each other. For example, a notch or slot antenna may be realized by forming an aperture of predetermined size and shape in a conductive body, by folding a conductive body to form an aperture, or by arranging plural contacting conductive bodies to define an aperture. Such a system of radiating bodies and/or apertures defined thereby may be configured to exhibit a predetermined complex impedance that facilitates the system to electrically resonate in one or more predetermined frequency bands, by conduction of current through the system of radiating bodies, so as to conduct varying electrical currents therein, and hence electromagnetically radiate and/or respond to electromagnetic radiation as an antenna in said frequency bands, as would be readily understood by a worker skilled in the art. The system of radiating bodies and/or apertures may define a substantially two-dimensional or three-dimensional antenna structure. For example, in some embodiments, the first antenna may be a loop antenna, a magnetic dipole antenna, a patch antenna, a folded-patch antenna, an aperture antenna, a slot antenna, a notch antenna, a folded notch antenna, or a notch-in-notch antenna, a PIFA, a top loaded monopole or another type of antenna, as would be readily understood by a worker skilled in the art.

In embodiments of the present technology, the first antenna is a notch-in-notch antenna. The notch-in-notch antenna comprises a conductive first plate and a conductive second plate. The conductive first plate and the conductive second plate may be disposed and have an electrical connection to form an external antenna structure having a substantially U-shaped cross section. The conductive first plate and the conductive second plate may have electrical lengths with respect to the electrical connection corresponding to substantially an odd integer multiple of a quarter of a guide wavelength associated with a resonant frequency of the antenna. According to some embodiments, this length may be reduced with capacitive loading such as a discrete capacitor. The notch-in-notch antenna comprises a conductive third plate disposed substantially parallel to the conductive first plate between the conductive first plate and the conductive second plate. The conductive third plate may have a proximate edge proximate the electrical connection. The conductive third plate forms part of an internal antenna structure.

Figure 4:
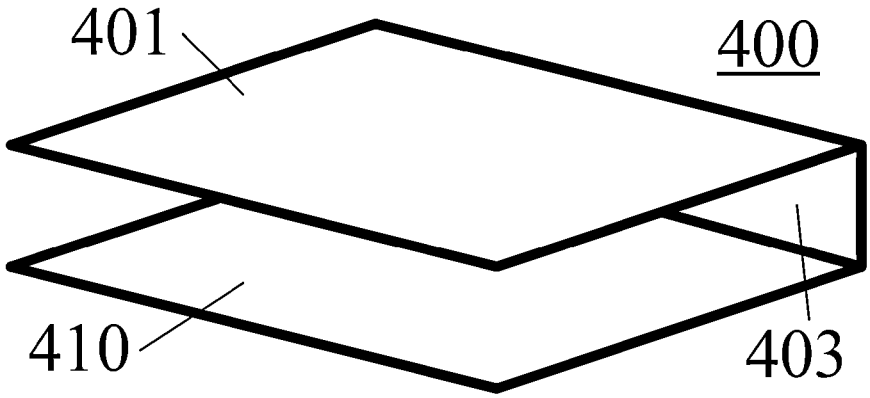
FIG. 4 illustrates a first antenna, in accordance with an embodiment of the technology.

FIG. 4 illustrates a radiating body or system of radiating bodies 400 configured as a notch antenna, which may be provided as a first antenna and/or additional antenna according to some embodiments of the present technology. The notch antenna comprises a conductive first plate 410, a conductive second plate 401, and an electrical connection 403 between the conductive first plate 410 and the conductive second plate 401. It is noted that while the conductive first plate 410, the conductive second plate 401 and the electrical connection 403 are configured as substantially flat, rectangular, solid bodies, they can be shaped differently in other embodiments. For example, other embodiments can have a conductive first plate, conductive second plate and/or electrical connection that has a curved surface, quadratic, polygonal or irregular circumference, solid or hollow interior and/or is otherwise configured. According to some embodiments, the width of conductor 403 may be substantially less than that for the conductive second plate 401 or the conductive second plate 410. This narrowing can result in an increase of the shunt inductance and typically cause the resonant frequency to decrease to permit the size of the conductive first plate 410 and/or the conductive second plate 401 to be decreased for the same frequency.

The interior of the notch antenna 400 may be hollow or filled with a dielectric material. Depending on the embodiment, the conductive first plate 410 and the conductive second plate 401 may be substantially parallel, tapered towards or away from the electrical connection 403, oblique, or otherwise aligned relative to each other. The notch antenna may have a substantially "C"-shaped cross section. The notch antenna may alternatively be a folded notch antenna, or have another shaped cross section. The notch antenna may be dimensioned for radio transmission and/or reception in a predetermined range of operating frequencies.

Figure 5A:
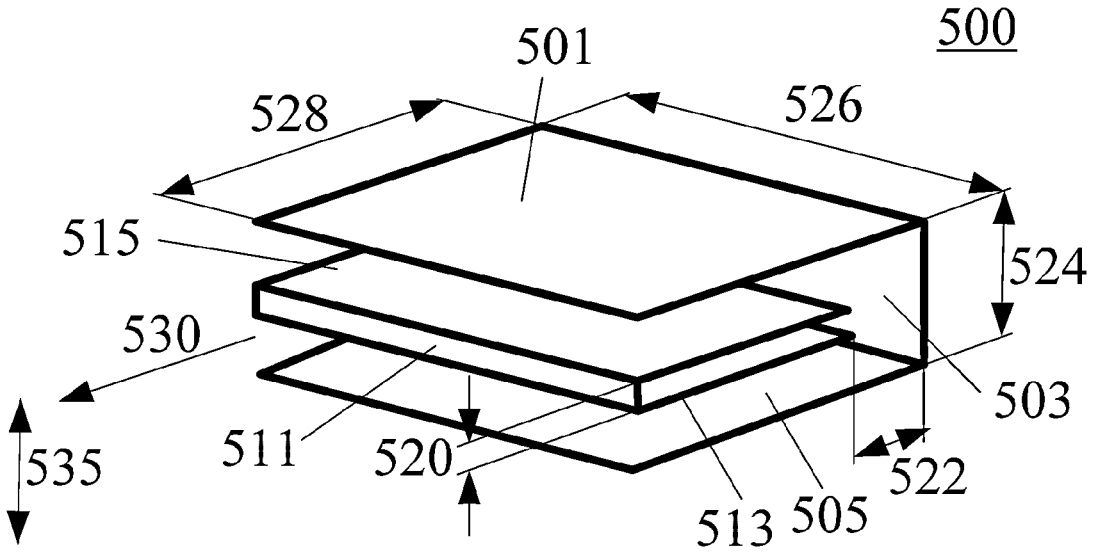
FIGS. 5A and 5B illustrate a first antenna, in accordance with another embodiment of the technology.
Figure 5B:
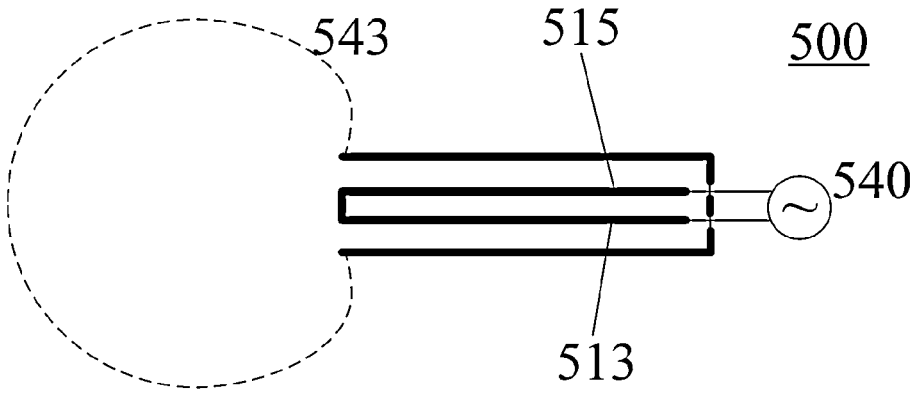

FIGS. 5A and 5B illustrate an example antenna 500, which may be provided as a first antenna and/or additional antenna according to an embodiment of the present technology. FIG. 5A illustrates a perspective view of the antenna 500, and FIG. 5B illustrates a side view of the antenna 500. FIG. 5B further illustrates an example connection to a signal drive source 540 for providing a signal to the antenna 500 for signal transmission purposes and a schematic illustration of a portion of a radiation pattern 543 of the antenna 500. In some embodiments, the antenna 500 can be configured to provide a bandwidth of up to or more than about 17% of its resonant frequency.

The antenna 500 comprises an external antenna structure having: a conductive first plate 505, a conductive second plate 501, and a back plate 503; and an internal antenna structure having a front plate 511, a conductive third plate 513, and a conductive fourth plate 515. The conductive plates are electrically interconnected and configured as solid, substantially flat, rectangular, conductive plates having substantially equal depth 526. According to some embodiments, in the same manner as for the back plate 503, the front plate 511 can be made narrower in width thereby providing for decreased size for the third plate 513 and the fourth plate 515 or else decreasing the operating frequency of the antenna. The antenna 500 may be integrally formed from two elongate substantially rectangular pieces of electrically conductive material such as copper, by folding or other method, for example. The internal antenna structure formed by the front plate 511, the conductive third plate 513, and the conductive fourth plate 515 may be durably disposed within the external antenna structure by a suitable dielectric that at least partially fills the space in between the conductive first plate 505 and the conductive second plate 501, for example. This will typically permit frequency reduction and/or size reduction, however the bandwidth will typically decrease as the dielectric constant increases. The back plate 503 provides the electrical connection between the conductive first plate 505 and the conductive second plate 501. The conductive third plate 513 and the conductive fourth plate 515 are of substantially equal size but can have different sizes in other embodiments.

The antenna 500, including the conductive first plate 505 and the conductive second plate 501, has a length 528 with respect to the electrical connection provided by back plate 503 corresponding with about a quarter of an operating wavelength of the antenna 500. Depending on the embodiment, the height 524 of the antenna, the height 520 of the front plate 511 and the distance 522 between the proximate edge of the conductive third plate 513 and the back plate 503, can be different. The heights and distance 522, 524 and 520 can be configured to provide a predetermined bandwidth of the antenna 500 and to affect the radiation pattern in planes perpendicular to the conductive first plate 505. For example, the internal antenna structure may be centered within the external antenna structure, height 524 may be about a tenth of an operating wavelength, and height 520 and distance 522 may be about a fifth of height 524.

FIG. 5A also schematically illustrate a forward direction 530 in which the antenna 500 emits substantial amounts of electromagnetic radiation, the axis of polarization 535 of the emitted electromagnetic radiation in the forward direction 530. FIG. 5B illustrates a portion of a radiation pattern 543 of the antenna 500. The radiation pattern 543 will be substantially symmetrical if the antenna 500 is substantially symmetrical. In a far-field approximation, the electromagnetic radiation emitted by the antenna 500 appears to originate from about the center of the front plate 511 and is consequently offset from the back plate 503 by about length 528.

The antenna 500 may be partially or completely filled and/or coated (not illustrated) with one or more dielectric materials that are characterized by predetermined dielectric properties. For example, the space between the conductive first plate 505 and the conductive second plate 501, other than space occupied by the internal antenna structure, may be partially or fully filled with one or more dielectric materials. Remaining interfaces, if any, between dielectric materials and/or dielectric material and air may be curved, planar parallel, normal or oblique with respect to the conductive first plate 505. Dielectric material may also be applied by coating, painting or spraying one or more components of the antenna 500.

Figure 6A:
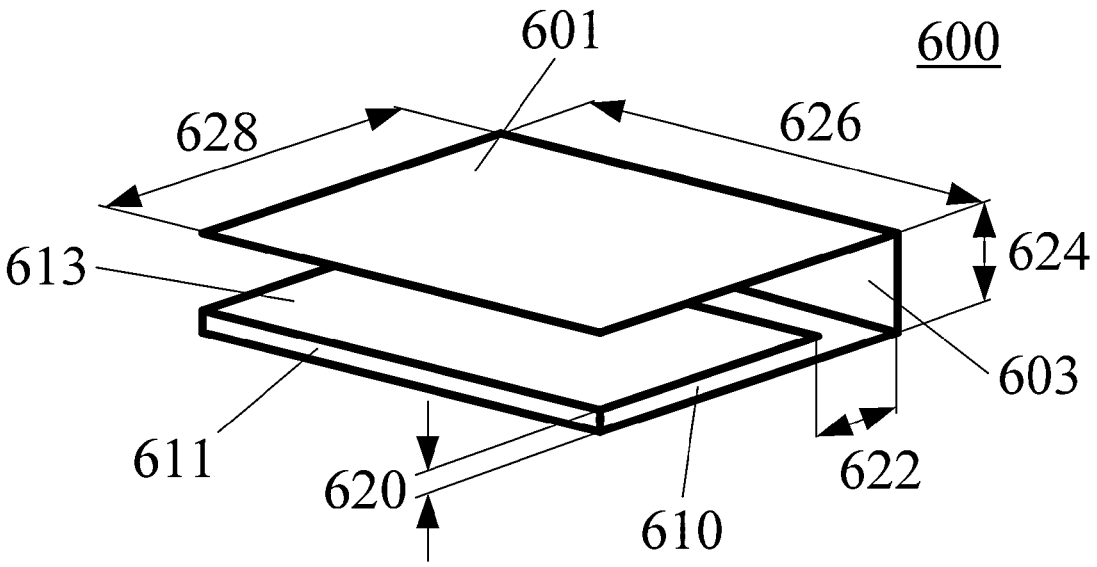
FIGS. 6A and 6B illustrate a first antenna, in accordance with yet another embodiment of the technology.
Figure 6B:
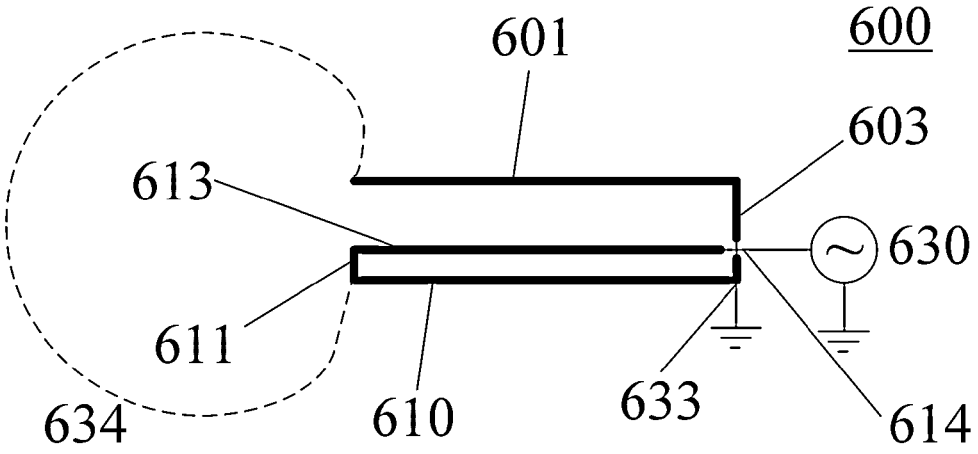

FIGS. 6A and 6B illustrate an example antenna 600, which may be provided as a first antenna and/or additional antenna according to an embodiment of the present technology. FIG. 6A illustrates a perspective view of the antenna 600, and FIG. 6B illustrates a side view of the antenna 600. FIG. 6B further illustrates an example connection to a signal drive source 630 for providing a signal to the antenna 600 for signal transmission purposes and a schematic illustration of a portion of a radiation pattern 634 of the antenna 600. The antenna 600 can be configured to provide a bandwidth of up to or more than about 17% of its resonant frequency.

The antenna 600 comprises a conductive first plate 610, a conductive second plate 601, a back plate 603, a front plate 611 and a conductive third plate 613, which are electrically interconnected and configured as solid, substantially flat, rectangular, conductive plates having substantially equal depth 626. The antenna 600 may be integrally formed from a single elongate substantially rectangular piece of material such as copper, by folding, for example. The back plate 603 provides the electrical connection between the conductive first plate 610 and the conductive second plate 601.

The antenna 600, including the conductive first plate 610 and the conductive second plate 601, have a length 628 with respect to the electrical connection corresponding with a quarter of an operating wavelength of the antenna 600. Depending on the embodiment, the height 624 of the antenna, the height 620 of the front plate 611 and the distance 622 between the proximate edge of the conductive third plate 611 and the back plate 603, can vary within predetermined ranges. The heights and distance 622, 624 and 620 can be configured to provide a predetermined bandwidth of the antenna 600 and to affect the radiation pattern in planes perpendicular to the conductive first plate 610. In a far-field approximation, the electromagnetic radiation emitted by the antenna 600 appears to originate from about the center of the opening proximate the front plate 611 and is consequently offset from the back plate 603 by about length 628.

According to some embodiments, the antenna system may also provide for the narrowing of the width of the back plate 603 and the front plate 611. However this narrowing may result in the operating frequency being reduced and/or the size for a given frequency may be reduced.

The antenna 600 may be partially or completely filled and/or coated (not illustrated) with one or more dielectric materials that are characterized by predetermined dielectric properties. For example, the space 620 between the conductive first plate 610 and the conductive third plate 613 may be partially or fully filled with one or more dielectric materials. Interfaces between dielectric materials and/or dielectric material and air remaining in the space 620 may be parallel, normal or oblique with respect to the conductive first plate 610. Dielectric material may also be applied by coating, painting or spraying one or more components of the antenna 600.

The depth 626 of the antenna can be configured to substantially affect the radiation pattern of the antenna 600 within planes parallel to the conductive first plate 610. An example geometry of the antenna 600 may be characterized by length 628=$\lambda_0/4$, depth 626=$\lambda_0/4$, height 624=$\lambda_0/10$, distance 622=$\lambda_0/40$, and height 520=$\lambda_0/40$, wherein "=" corresponds to nominal values that are equal or about the specified value as defined herein, and $\lambda_0$ is an operating wavelength of the antenna, for example corresponding to an antenna center operating frequency $f_0$, for example via the usual inverse relationship $\lambda_0=v/f_0$, where v corresponds to a velocity of electromagnetic radiation in an appropriate medium. Other example antennas can be characterized by other widths, depths, heights and/or lengths. It is noted that antennas having different dimensions can have a different operating wavelength $\lambda_0$ even if the antennas are characterized by substantially equal length 628.

As illustrated in FIG. 6B, the antenna 600 may be grounded. The grounding may occur at a predetermined point along edge 633, along the whole edge 633, the whole conductive first plate 610 may be used as a ground plate, or other grounding may be provided. The signal drive source is operatively connected to the antenna at feed point 614 through an opening in the back wall 603. It is noted that other antennas may be grounded in other locations, the feed point may be provided in other locations, and/or more than one feed point may be provided. It is further noted that the specific location(s) of the one or more feed points and/or of the grounding of the antenna can affect the guide wavelength, bandwidth and/or other characteristics of an antenna. Alternatively, the antenna 600 may be ungrounded, and fed, for example, by a balanced transmission line operatively coupled between the signal source 630 and the antenna 600, for example as shown in FIG. 6B, but with the grounds at 630 and 633 replaced by a second conductor of the balanced transmission line.

According to some embodiments, the antenna 600 may be grounded at 633 or the antenna can be fed by a balanced transmission line.

An example configuration of the antenna 600 can be dimensioned and formed from a piece of 28 mm wide copper as follows. The conductive first plate 610 and the conductive second plate 601 are about 28 mm by about 28 mm in size. The back plate 603 is about 10 mm high by about 28 mm wide. The first plate 610 and the third plate 611 are separated by a dielectric body characterized by a relative dielectric constant of about 3.6 and a thickness of 0.5 mm. The dielectric body is about 28 mm wide and about 21 mm deep. The piece of copper is folded around the dielectric body providing an integrally formed conductive first plate, conductive second plate, conductive third plate, conductive back plate and conductive front plate. The conductive third plate is dimensioned to provide distance 622 of about 5 mm. A return loss of 10 dB can be accomplished using, for example, a predetermined printed inductor disposed in combination with a predetermined printed shunt capacitor between the feed point 614 and the signal drive source 630. The resulting antenna when disposed on a ground plane about 50 mm by about 50 mm can be characterized by a bandwidth of about 310 MHz and a center frequency of about 1860 MHz, corresponding to a free space wavelength of 161 mm, a bandwidth of 16.6%, a predetermined flat return loss within the bandwidth, a substantially perpendicular polarization, about omnidirectional within 2 dB (+/−1 dB) radiation pattern in a plane perpendicular to the polarization, and an efficiency about 70% or better within the bandwidth.

Second Antenna

In accordance with the present technology, there is provided a second antenna comprising the first system and a second system of one or more radiating bodies, the first system and the second system configured to be driven differentially with respect to each other as a dipole antenna. For example, the outer shell or shells of the first system of radiating bodies may operate as a first half of a substantially center-fed dipole antenna, and the outer shell or shells of the second system of radiating bodies may operate as a second half of the dipole antenna. The second, dipole antenna may be operatively coupled to a feedpoint located between the first system of radiating bodies and the second system of radiating bodies, for example across a gap. For example, a first or inner conductor of a transmission line may be operatively coupled to one of the first and second system of radiating bodies on a first side of the gap, and a second outer conductor, or ground, of a transmission line may be operatively coupled to the other system of radiating bodies on another side of the gap opposite the first side. In embodiments of the present technology, each of the first system of radiating bodies and the second system of radiating bodies may operate, at least at the operating frequencies of the second antenna, as single, integrated radiating bodies.

In some embodiments, the second system may be physically and electrically similar to the first system, and spaced apart from the first system by an adequately sized gap, the first system and the second system thereby forming two halves of a substantially symmetric center-fed dipole antenna. The second antenna may be operatively coupled to a transmission line at a feed point located at the gap, as would be readily understood by a worker skilled in the art.

In some embodiments, the second system of one or more radiating bodies is further configured as an additional antenna, for example similarly to the first antenna. The additional antenna may, for example, operate in the same frequency range and with the same polarization as the first antenna. According to some embodiments, due to spatial separation, co-polarised MIMO/Diversity antennas can be achieved. The first and additional antenna may be operated substantially concurrently to facilitate increased gain and/or antenna diversity, or to provide for separate transmitting and receiving antennas. In other embodiments, the second system is not connected as an additional antenna.

The second antenna comprises the first system of radiating bodies configured as the first antenna, and optionally the second system of radiating bodies is configured as an additional antenna. The second antenna therefore re-uses radiating bodies of the first and possibly additional antenna, thereby providing an efficient use of space. The second antenna is operatively coupled to a second transmission system at a location different from the first transmission system and optionally an additional transmission system of the first antenna and additional antennas, respectively. Isolating means, such as wave traps, impedance elements, transmission line routings, Butler matrix and the like, may also be provided between different antennas and transmission systems. This arrangement may allow for concurrent operation of the first, second, and optionally additional antenna.

Third Antenna

In accordance with the present technology, there is provided a third antenna comprising a conductive body and a third system, the third system including the first system or the second system or both, wherein the third system is configured to be driven differentially with respect to the conductive body.

In some embodiments, the third antenna is a dipole antenna, with the conductive body forming a radiating body or system of radiating bodies which may be electrically and/or physically similar to the third system of radiating bodies. The conductive body may be a planar body, for example a sheet of conductive material such as metal. In some embodiments, the third antenna is a monopole antenna, with the conductive body forming at least part of a ground plane or counterpoise. In some embodiments, the third antenna may be a substantially symmetric or asymmetric, center-fed dipole. The outer shell or shells of the third system of radiating bodies may operate as a portion of the third antenna.

In some embodiments, the third antenna is configured as an antenna system similar to the combination of the first and second antennas previously described. In this configuration, there are four slot/patch styled antennas in a rectangular array. Each of these antennas, by virtue of their spatial placement, can have some useable orthogonality thereby enabling a 4×4 MIMO system for example. In addition, according to some embodiments, 4 dipole sets can be realized as two parallel sets, each at right angles to each other in the horizontal plane, wherein this configuration can be useful at higher frequencies. According to embodiments, this system can be further expanded to a N by M array.

In some embodiments, the conductive body and third system may be arranged in a spaced-apart configuration, with the third antenna driven at a feedpoint located substantially at a gap between the conductive body and the third system. For example, a first or inner conductor of a transmission line may be operatively coupled to the third system of radiating bodies on a first side of the gap, and a second outer conductor, or ground, of a transmission line may be operatively coupled to the conductive body on another side of the gap opposite the first side.

In some embodiments, the third antenna comprises the conductive body and one of the first system and the second system of radiating bodies, and an additional antenna comprises the conductive body and the other of the first system and the second system of radiating bodies. This additional antenna, may, for example, be configured similarly to the third antenna. The third and additional antenna may be operated substantially concurrently to facilitate increased gain and/or antenna diversity, or to provide for separate transmitting and receiving antennas.

The third antenna comprises the first system and/or the second system of radiating bodies, and therefore re-uses radiating bodies of the first and/or second antenna, thereby providing an efficient use of space. The third antenna is operatively coupled to a third transmission system at a location different from the first and second transmission systems of the first antenna and second antennas, respectively. Isolating means, such as wave traps, impedance elements, transmission line routings, and the like, may also be provided between different antennas and transmission systems. This arrangement may allow for concurrent operation of the first, second, and third antenna.

Multi-Antenna Configurations

The first antenna, second antenna, and/or third antenna, described above may be collectively configured in a variety of ways, for example to facilitate adequate antenna diversity or MIMO performance, and/or compactness.

In embodiments of the present technology, at least two of the first antenna, the second antenna, and the third antenna are configured for concurrent operation. Each antenna may be operatively coupled to a different signal source and/or sink, and to different, possibly overlapping transmission systems, which are configured for concurrent operation. By feeding the different antennas at different locations and with different signals, plural antennas of the compact multi-antenna and/or compact multi-antenna system may be operated substantially concurrently, or independently.

In embodiments of the present technology, the first antenna is contained within the second antenna, and the second antenna is contained at least in part within the third antenna. This configuration facilitates a compact multi-antenna, since radiating bodies of the first antenna are re-used to form part of the second antenna, and radiating bodies of the second antenna are re-used to form part of the third antenna. In some embodiments, the first antenna is contained within the second antenna, and the second antenna is partially contained within the third antenna. In this embodiment, the first antenna may also be contained within the third antenna, or the first antenna may be outside of the third antenna.

Due to re-use of radiating bodies, embodiments of the present technology may facilitate providing a compact multi-antenna and multi-antenna system. This may be advantageous when space is at a premium, for example within handheld mobile wireless devices, wireless devices within a peripheral such as a USB™ stick, or the like. The compact multi-antenna may be relatively thin, for example residing within a substantially planar region, thereby further facilitating compactness in at least one dimension.

In embodiments of the present technology, the first antenna has a first polarization, the second antenna has a second polarization different from the first polarization, and the third antenna has a third polarization different from the first polarization and the second polarization. In some embodiments, the first polarization may be substantially orthogonal to the second polarization, and the third polarization may be substantially orthogonal to the first polarization and the second polarization. Multiple antennas with different polarizations may be used for improving communication performance and reliability, for example via antenna diversity and/or MIMO, as would be readily understood by a worker skilled in the art. For example, differently polarized signals may exhibit different characteristics, such as signal-to-noise and fading characteristics, in a multipath environment. By utilizing multiple differently polarized signals, communication integrity may be better maintained even during fading of some of the differently polarized signals.

In embodiments of the present technology, the first antenna, the second antenna and the third antenna are configured for operation at least in part within a predetermined common frequency band. In some embodiments, different antennas may be configured for operation in different frequency bands, thereby facilitating operation in a wider frequency range than is obtainable using only one of the antennas.

In embodiments of the present technology, the various radiating and/or conductive bodies of the first, second and third antenna may be configured to occupy a predetermined area and/or volume. For example, the first system of radiating bodies may be configured as conductive plates as opposed to conductive wires, the plates having a predetermined width. Use of such elements may facilitate the antennas having a broader bandwidth when compared to thin wire antennas, which is desirable in many communication applications.

In embodiments of the present technology, the multi-antenna may be configured with features such as antenna matching elements, top loading elements, or other physical features for adjusting electrical characteristics of the first, second and/or third antennas such as input or output impedance, electrical length, or the like. Such features may be formed by shaping the radiating bodies and/or conductive body to include protrusions, gaps, or the like, as would be readily understood by a worker skilled in the art. In some embodiments, the radiating bodies and/or conductive body may be rectangular, tapered, substantially planar, substantially three-dimensional, or the like, depending on desired features such as radiation pattern, bandwidth, polarization, and the like.

In embodiments of the present technology, the radiating bodies, conductive bodies, and/or transmission lines may be formed at least in part as conductive surfaces on a printed circuit board having one or more layers.

Antenna Transmission Systems

Aspects of the present technology relate to a multi-antenna system comprising a multi-antenna, as described herein, along with a plurality of transmission systems operatively coupled to the multi-antenna. The plurality of transmission systems may be configured in various ways, as described herein, for operating the plural antennas of the multi-antenna, for example concurrently.

The plurality of transmission systems may comprise a first transmission system operatively coupled to the first system of one or more radiating bodies, corresponding to the first antenna. The plurality of transmission systems may also comprise a second transmission system operatively coupled to the first system and the second system, corresponding to the second antenna, and configured for differential operation of first system and the second system as a dipole antenna. The plurality of transmission systems may also comprise a third transmission system operatively coupled to conductive body and the third system, corresponding to the third antenna, the third transmission system for operation of said third system differentially with respect to the conductive body.

In some embodiments, for example as illustrated in FIG. 2, there is provided a multi-antenna system wherein the third system of radiating bodies includes both the first system and the second system. A coupling transformer is provided, common to the second transmission system and the third transmission system. The coupling transformer is configured to convey a differential signal corresponding to the second transmission system for differential operation of the second antenna. The coupling transformer is further configured to convey a common-mode signal corresponding to the third transmission system for operation of the first system and the second system together and differentially of the conductive body. The first system and the second system may be driven with substantially in-phase signals for transmission, for example.

In some embodiments, for example as illustrated in FIG. 3, there is provided a multi-antenna system. The second transmission system is operatively coupled to a feedpoint of the second antenna. The feedpoint of the second antenna is located between the first system and the second system. The third transmission system is operatively coupled to one or more feedpoints of the third antenna. At least one of the one or more feedpoints of the third antenna located between the conductive body and the third system. The one or more feedpoints of the third antenna are spaced apart from the feedpoint of the second antenna.

Wireless Device

Aspects of the present technology relate to a wireless device comprising and operatively coupled to a multi-antenna and/or multi-antenna system as described herein.

Figure 7:
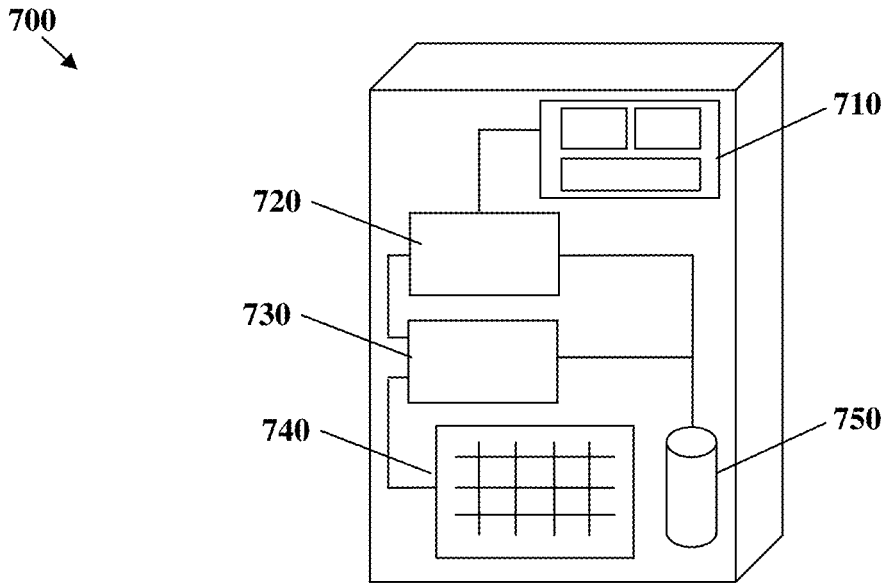
FIG. 7 illustrates a hand-held wireless device comprising a compact multi-antenna, in accordance with an embodiment of the technology.

FIG. 7 illustrates a handheld wireless device 700, such as a cellular phone, smart phone, PDA, or the like, in accordance with embodiments of the present technology. The wireless device 700 comprises a multi-antenna system 710 comprising a multi-antenna and a plurality of transmission systems operatively coupled thereto, as described herein. The wireless device 700 further comprises RF electronics 720 operatively coupled to the multi-antenna system 710 via the plurality of transmission systems. The RF electronics 720 may include RF front-end components, such as power amplifiers for transmission, low-noise amplifiers for receiving, matching circuitry, filtering circuitry, switching circuitry, and the like, as would be readily understood by a worker skilled in the art. The wireless device 700 further comprises other electronics 730 such as digital electronics operatively coupled to the RF electronics 720, and configured for supporting communication operations, user interface operations, and other operations of the wireless device 700, as would be readily understood by a worker skilled in the art. The wireless device 700 further comprises a user interface 740, for example comprising buttons, touch screen, video display, speakers, microphones, or the like, the user interface operatively coupled to the electronics 730. The wireless device 700 further comprises a power source 750 such as a battery, operatively coupled at least to the electronics 720, 730 for powering same.

Figure 8:
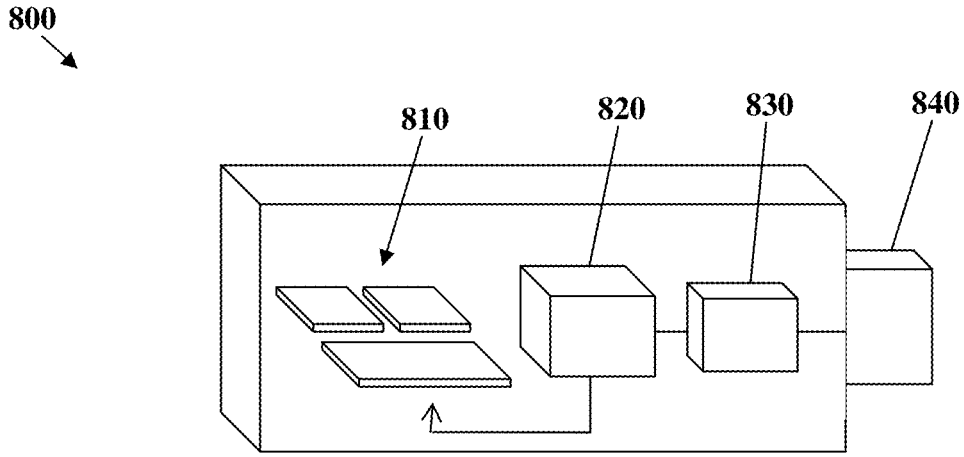
FIG. 8 illustrates a peripheral wireless device comprising a compact multi-antenna, in accordance with another embodiment of the technology.

FIG. 8 illustrates a peripheral wireless device 800, such as a USB™ adaptor for connection to a computer, in accordance with embodiments of the present technology. The wireless device 800 comprises a multi-antenna system 810 comprising a multi-antenna and a plurality of transmission systems operatively coupled thereto, as described herein. The wireless device 800 further comprises RF electronics 820 operatively coupled to the multi-antenna system 810 via the plurality of transmission systems. The RF electronics 820 may include RF front-end components, such as power amplifiers for transmission, low-noise amplifiers for receiving, matching circuitry, filtering circuitry, switching circuitry, and the like, as would be readily understood by a worker skilled in the art. The wireless device 800 further comprises other electronics 830 such as digital electronics operatively coupled to the RF electronics 820, and configured for supporting communication operations, user interface operations, and other operations of the wireless device 800, as would be readily understood by a worker skilled in the art. The wireless device 800 further comprises a peripheral interface 840, such as a USB™ connector, which is configured to operatively couple the other electronics 830 to a computer. The other electronics 830 and/or peripheral interface 840 may comprise electronics for appropriately encoding and managing signals passed through the peripheral interface 840. The peripheral interface 840 may further be configured to supply power from the computer to at least to the electronics 820, 830.

In some embodiments, the multi-antenna is substantially planar, thereby, for example, facilitating compact sizing of the wireless device, particularly in the dimension orthogonal to the plane of the multi-antenna. The first antenna, second antenna and third antenna, and conductive and radiating bodies thereof, may thus be disposed in a common, substantially planar region. A substantially planar multi-antenna system still occupies a three-dimensional volume, but measurement of this volume in one direction, for example corresponding to height or thickness, substantially smaller than measurements in other directions.

It is obvious that the foregoing embodiments of the technology are examples and can be varied in many ways. Such present or future variations are not to be regarded as a departure from the spirit and scope of the technology, and all such modifications as would be obvious to one skilled in the art are intended to be included within the scope of the following claims.

I claim:

1. A multi-antenna comprising:

a a first system of one or more radiating bodies configured as a first antenna;

b. a second antenna comprising the first system and a second system of one or more radiating bodies, the first system and the second system configured to be driven differentially with respect to each other as a dipole antenna; and c. a third antenna comprising a conductive body and a third system, the third system including the first system or the second system or both, wherein the third system is configured to be driven differentially with respect to the conductive body;

wherein the first, second, and third antennas are each configured to be driven independently of one another.

2. The multi-antenna of claim 1, wherein the second system of one or more radiating bodies is further configured as an additional antenna.

3. The multi-antenna of claim 1, wherein at least two of the first antenna, the second antenna, the third antenna are configured for concurrent operation.

4. The multi-antenna of claim 1, wherein the first antenna is contained within the second antenna, and wherein the second antenna is contained at least in part within the third antenna.

5. The multi-antenna of claim 1, herein the first antenna has a first polarization, the second antenna has a second polarization different from the first polarization, and the third antenna has a third polarization different from the first polarization and the second polarization.

6. The multi-antenna of claim 3, wherein the first polarization is substantially orthogonal to the second polarization, and the third polarization is substantially orthogonal to the first polarization and the second polarization.

7. The multi-antenna of claim 1, wherein the first antenna, the second antenna, and the third antenna are disposed in a common, substantially planar region.

8. The multi-antenna of claim 1, wherein the first antenna is selected from the group comprising: a loop antenna; a magnetic dipole antenna; a folded-patch antenna; a notch antenna; and a notch-in-notch antenna.

9. The multi-antenna of claim 1, wherein the first antenna comprises:

a. a conductive first plate and a conductive second plate, the conductive first plate and the conductive second plate disposed and having an electrical connection between an edge of the conductive first plate and an edge of the conductive second plate to form an external antenna structure, the conductive first plate and the conductive second plate having electrical lengths in substantially the same direction with respect to the electrical connection corresponding to substantially an odd integer multiple of a quarter of a guide wavelength associated with a resonant frequency of the antenna; and b. a conductive third plate disposed substantially parallel to the conductive first plate between the conductive first plate and the conductive second plate, the conductive third plate having a proximate edge near the electrical connection while being at least substantially free from contact with the electrical connection, and having a distant edge opposite the electrical connection;

wherein the conductive third plate forms part of an internal antenna structure; and wherein the internal antenna structure is at least substantially free from contact with the electrical connection.

10. The multi-antenna of claim 1, wherein the first antenna, the second antenna and the third antenna are configured for operation at least in part within a predetermined common frequency band.

11. A multi-antenna system comprising:

a. a first system of one or more radiating bodies configured as a first antenna;

b. a first transmission system operatively coupled to the first system and configured for operation of the first system as an antenna;

c. a second antenna comprising the first system and a second system of one or more radiating bodies, the first system and the second system arranged in a spaced-apart configuration;

d. a second transmission system operatively coupled to the first system and the second system and configured for differential operation of first system and the second system as a dipole antenna;

e. a third antenna comprising a conductive body and a third system, the third system including the first system or the second system or both; and f. a third transmission system operatively coupled to conductive body and the third system, the third transmission system for operation of said third system differentially with respect to the conductive body;

wherein the first, second and third antennas are each configured to be driven independently of one another.

12. The multi-antenna system of claim 11, wherein the third system includes both the first system and the second system, the multi-antenna system further comprising a coupling transformer common to the second transmission system and the third transmission system, the coupling transformer configured to convey a differential signal corresponding to the second transmission system for differential operation of the second antenna, the coupling transformer further configured to convey a common-mode signal corresponding to the third transmission system for operation of the first system and the second system together and differentially of the conductive body.

13. The multi-antenna system of claim 11, wherein the second transmission system is operatively coupled to a feedpoint of the second antenna, the feedpoint of the second antenna located between the first system and the second system, and wherein the third transmission system is operatively coupled to one or more feedpoints of the third antenna, at least one of the one or more feedpoints of the third antenna located between the conductive body and the third system, the one or more feedpoints of the third antenna spaced apart from the feedpoint of the second antenna.

14. The multi-antenna system of claim 11, wherein at least one of the first transmission system, the second transmission system and the third transmission system comprises a transmission line selected from the group comprising: a microstrip transmission line, a stripline transmission line, and a coaxial transmission line.

15. A wireless device comprising the multi-antenna according to claim 1.

16. A wireless device comprising the multi-antenna system according to claim 11.

* * * * *

UNITED STATES PATENT AND TRADEMARK OFFICE

CERTIFICATE OF CORRECTION

PATENT NO. : 8,907,857 B2
APPLICATION NO. : 13/247443
DATED : December 9, 2014
INVENTOR(S) : Nysen It is certified that error appears in the above-identified patent and that said Letters Patent is hereby corrected as shown below:

IN THE CLAIMS

CLAIM 1, Line 14 Replace "antennas" with "antennae"
Col. 19, Line 4

CLAIM 5, Line 1 Replace "herein" with "wherein"
Col. 19, Line 15

Signed and Sealed this
Tenth Day of March, 2015

Michelle K. Lee

Michelle K. Lee
*Deputy Director of the United States Patent and Trademark Office*